US007171326B2

(12) United States Patent
Gerber et al.

(10) Patent No.: US 7,171,326 B2
(45) Date of Patent: Jan. 30, 2007

(54) METHOD FOR OPERATING A SLIDING GATE, AND SLIDING GATE

(75) Inventors: Pierre Gerber, Zumikon (CH); Urs Basler, Arth (CH)

(73) Assignee: Stopinc Aktiengesellschaft, Hunenberg (CH)

( * ) Notice: Subject to any disclaimer, the term of this patent is extended or adjusted under 35 U.S.C. 154(b) by 0 days.

(21) Appl. No.: 10/509,424

(22) PCT Filed: Mar. 22, 2003

(86) PCT No.: PCT/EP03/03006

§ 371 (c)(1),
(2), (4) Date: Jun. 21, 2005

(87) PCT Pub. No.: WO03/080274

PCT Pub. Date: Oct. 2, 2003

(65) Prior Publication Data

US 2005/0242094 A1 Nov. 3, 2005

(30) Foreign Application Priority Data

Mar. 25, 2002 (CH) ..... 0513/02

(51) Int. Cl.
*B22D 41/08* (2006.01)

(52) U.S. Cl. ..... 702/130; 222/600; 222/590; 266/236

(58) Field of Classification Search ..... 702/130; 222/600, 590; 266/236
See application file for complete search history.

(56) References Cited

U.S. PATENT DOCUMENTS 4,480,771 A * 11/1984 Meier ..... 222/598
5,939,016 A * 8/1999 Mathiesen et al. ..... 266/45

* cited by examiner

*Primary Examiner*—John Barlow
*Assistant Examiner*—Cindy D. Khuu
(74) *Attorney, Agent, or Firm*—Wenderoth, Lind & Ponack, L.L.P.

(57) ABSTRACT

A method is provided for operating a sliding closure for a metallurgical vessel. The sliding closure includes two tensionable fireproof closure plates opposing one another, with each of the two closure plates being slideably positioned within a corresponding housing part. Spring elements are provided for tensioning the closure plates, wherein one of the closure plates, along with its corresponding housing part, is slideable and can be moved into a closed or open position by a drive member. The method comprises: performing an offline and/or an online diagnosis of an operating condition within an area of the closure plates, by measuring at least one of size, temperature, pressure and force associated with the sliding closure so as to obtain at least one measured value, and evaluating the at least one measured value either directly or together with additional relevant process parameters; and based upon the diagnosis, either continuing use of the sliding closure or discontinuing use of the sliding closure.

14 Claims, 2 Drawing Sheets

METHOD FOR OPERATING A SLIDING GATE, AND SLIDING GATE

BACKGROUND OF THE INVENTION

The invention concerns a method for operation of a sliding closure for metallurgic vessels, wherein the sliding closure incorporates at least opposingly tensionable fireproof closure plates which are each, slideably opposingly, positioned along glide surfaces within a housing part, wherein spring elements are envisaged for tensioning of the closure plates in at least one housing part, and wherein one closure plate with its housing part can be moved into a closed or open position by a drive member.

Sliding closures are utilized especially for pans or distribution containers of extrusion molding plants for a controlled pouring of steel smelt. Fireproof closure plates and fireproof sleeves utilized for these sliding closures, through which liquid steel smelt flows, as well as a mechanism supporting the same are subjected to relatively strong wear. The plates and sleeves must therefore be replaced frequently.

In order to achieve a high efficiency these fireproof parts are left within the sliding closure and used as long as possible. It has been demonstrated by operating personnel how emptying of pans can sometimes be achieved with aid of closure plates and sleeves with visual control and experience. In reality, however, it has been proven that breakouts occur due to incorrect estimates or insufficient control possibilities, where steel smelt flows in an uncontrolled manner through the sliding closure and damages or even destroys the same. This applies also to incorrect assemblies of the sliding closure where, for example, insufficient mortar has been installed between fireproof parts.

BRIEF SUMMARY OF THE INVENTION

Based on the aforementioned it is a purpose of this invention to provide a method for operation of a sliding closure of the above mentioned type with which operational safety can be increased and possible imminent operational faults such as breakouts can be recognized early.

This task is solved in accordance with the invention by an offline and/or online diagnosis of an operating condition, especially within an area of the closure plates, with which one or more of size, temperature, pressure and force associated with a sliding closure is measured, and this measured value is evaluated either directly or together with additional relevant process parameters in order to be able to judge the operating condition, and therefore, also a possible continued use of the sliding closure.

A method of this invention enables detection and prevention of operational faults and especially breakouts, during which sliding closure mechanics in their entirety and possibly also parts of an extrusion molding plant are often destroyed, as much as possible. Incorrect assemblies of the sliding closure especially can be detected and breakouts prevented in this way.

With a preferred embodiment, a distance of housing parts, receiving the closure plates, from one another in a transverse direction in relation to plate glide surfaces is used as a measured value, recorded, and transmitted to an evaluating device, wherein the distance is preferably measured in several places. This measuring of the distance of these two housing parts from one another especially enables diagnosing of a position of a closure plate with regard to changes in a transverse direction relative to the glide surfaces, and therefore, detection of sheets that may form between the plates.

A pressure of the drive member as well as a stroke position of the slideable closure plate are preferably used as parameters that are to be measured, i.e. recorded and evaluated, whereby frictional relationships, and therefore a condition of the closure plates especially, can be deducted from their contacting glide surfaces.

BRIEF DESCRIPTION OF THE DRAWINGS

Embodiments of the invention as well as further advantages of the same will now be described in more detail with reference to the drawing, wherein.

DETAILED DESCRIPTION OF THE PREFERRED EMBODIMENTS

Figure 1:
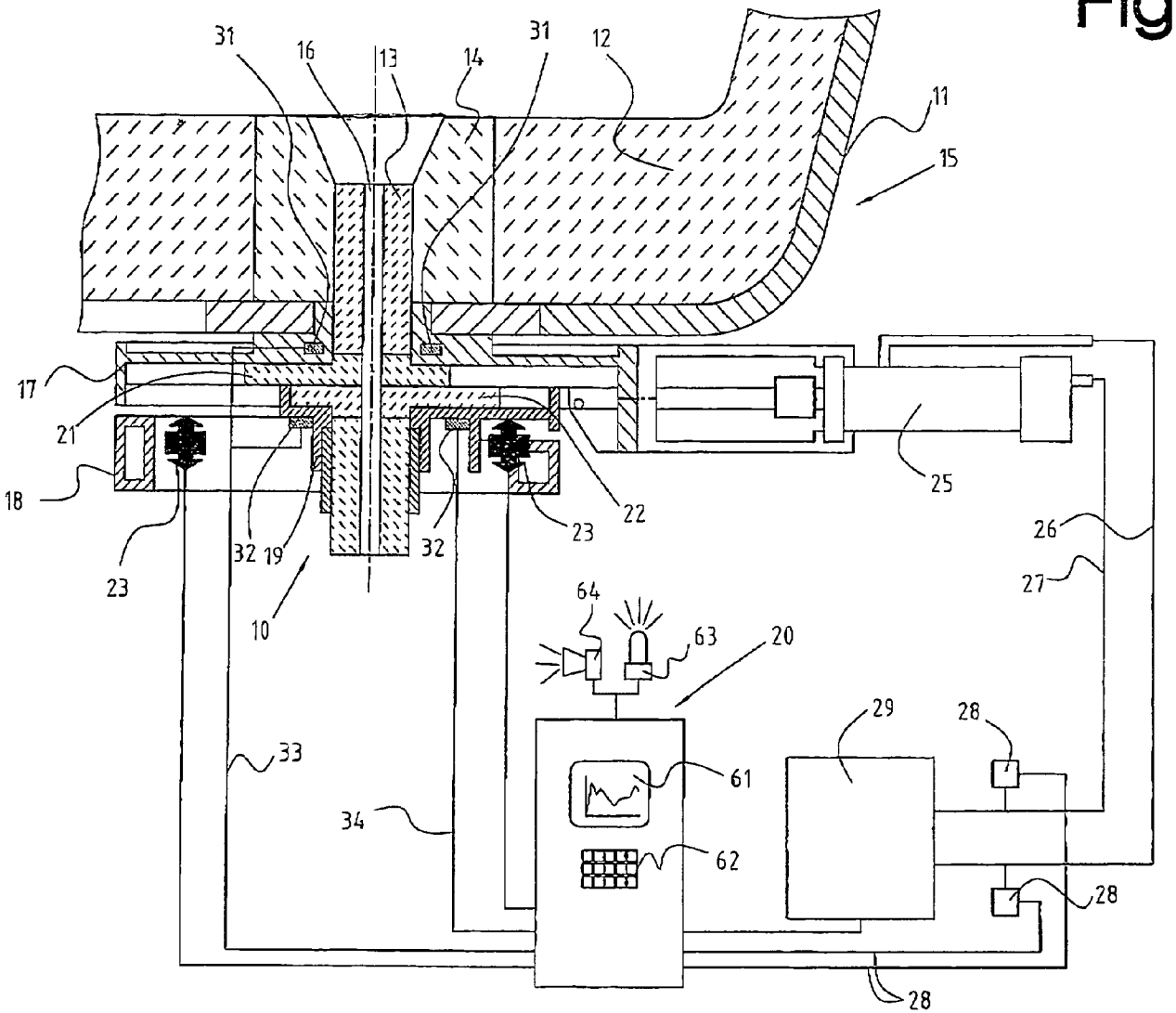
FIG. 1 shows a schematic illustration of a sliding closure as well as an evaluating device working according to a method of this invention.

FIG. 1 shows a schematic illustration of a sliding closure 10 affixed to a metallurgical vessel 15 illustrated only in part, whereby the same consists, for example, of a pan of an extrusion molding plant containing steel smelt. As part of the vessel 15 a steel jacket 11, a fireproof cladding 12, a perforated stone 14, as well as a fireproof sleeve 13 with an outlet 16 are shown.

The sliding closure 10 incorporates an upper housing part 17 into which a fireproof closure plate 21 is affixed. Within a further housing part 19 a slideable closure plate 22 is held, whereby the housing part 19 is held within a housing frame 18 and can be moved by a drive member 25 into an open position—as illustrated—or into a closed position. This drive member 25 takes the form of a hydraulic piston/cylinder unit and is therefore activated via pipes 26, 27 by a hydraulic aggregate 29. In addition the closure plates 21, 22 are pressed against one another by spring elements 23, so that an adequate seal is created between the closure parts.

According to the invention, a method for operation of the sliding closure 10 incorporates an offline and/or online diagnosis of an operating condition, especially within an area of the closure plates 21, 22, during which several values with regard to size, temperature, pressure and/or force of the sliding closure 10 are measured and evaluated, either directly or together with additional relevant process parameters, in order to be able to judge the operating condition and therefore also a possible continued use of the sliding closure 10.

During evaluation all values measured as actual values are compared with a target value or a target value range, and a display or the like for checking or emergency closure of the sliding closure is activated if deviations outside of a tolerance limit are found to exist.

Within the context of the invention, pressure of the drive member as well as a stroke position of the slideable closure plate are recorded and evaluated as one of the parameters to be measured, whereby especially frictional relationships, and therefore a condition of the closure plates, can be judged in this way with aid of their contacting glide surfaces. For this purpose the supply lines 26, 27 of the cylinder are equipped with pressure sensors 28 which measure actual pressure and supply corresponding signal values via electric cables 28' to an evaluating device 20.

During measuring of the pressure of the drive member conclusions regarding frictional relationships of the plates 21, 22, depending upon a stroke position of sliding plate 22 in relation to floor plate 21, and also regarding application pressures of the spring elements 23, can be reached. If a deviation from a relevant target value is detected a pouring process can either be discontinued, or the sliding closure plate can be subjected to a suitable inspection following conclusion of the pouring process, and a necessary replacement of the closure plates, or other defective parts, is performed depending on extent of deviation. As soon as the measured values return to within a tolerance value range following inspection, the sliding closure can be used again.

Further measured values consist of a temperature measured near the closure plates 21, 22. For this purpose the housing parts 17, 19 are equipped with measuring sensors 31, 32 at various points, whereby these sensors measure actual temperatures and transmit the same via relevant electric cables 33, 34 to the evaluating device 20. These temperature measurements enable detection of possible leaks where liquid steel could exit between a plate and sleeve, or between the plates, as early as possible in order to avoid breakouts. As soon as at least one of these temperatures deviates from a predetermined value the closure can either be closed immediately or a message can be sent to request an inspection depending on an extent of this deviation.

Effectively, the evaluating device 20 incorporates a computer with a monitor 61 and a keyboard 62 for programming and menu-driven administration of the method. In addition, an emergency light 63 and an alarm 64 are envisaged, with which possible operational faults of the sliding closure can be audibly, i.e. visually notified. The evaluating device 20 could of course also be connected to an external computer, i.e. a central computer, located for example at a control center.

In addition, an application pressure of the spring elements 23 that tension the closure plates 21, 22 can be measured in order to determine whether one or more of the spring elements 23 are no longer functional. Such a measurement can be performed with aid of an expansion measurement strip or a piezo element or the like.

These pressure measurements as well as temperature measurements can be performed online, i.e. during a pouring process, or offline, i.e. after a pouring process, when the sliding closure has been positioned at an assembly location together with the pan.

A target value or a target value range of parameters that are to be measured can be adjusted with aid of additional process parameters during use of the sliding closure. In this way it is, for example, possible that wear of the glide surfaces, i.e. flow passages, of the closure plates will have an effect on temperatures detected by the measuring sensors 31, 32. In the same way it is possible that a temperature increase occurs during use of the closure plates without any kind of defect being present. These changes are defined as kinds of process parameters which are borne in mind during evaluation of measured values.

A further characteristic of the method of this invention envisages that a protocolling and a storing of measured values of the sliding closure will supply information regarding the pan and smelt to be poured with regard to temperature, treatment, pouring time and the like. These stored values also serve as process parameters to be considered during evaluation, with which target values are adjusted and a filtering process as part of comparison of measured dimensions is performed with the target values in order to exclude false alarms as much as possible.

Figure 2:
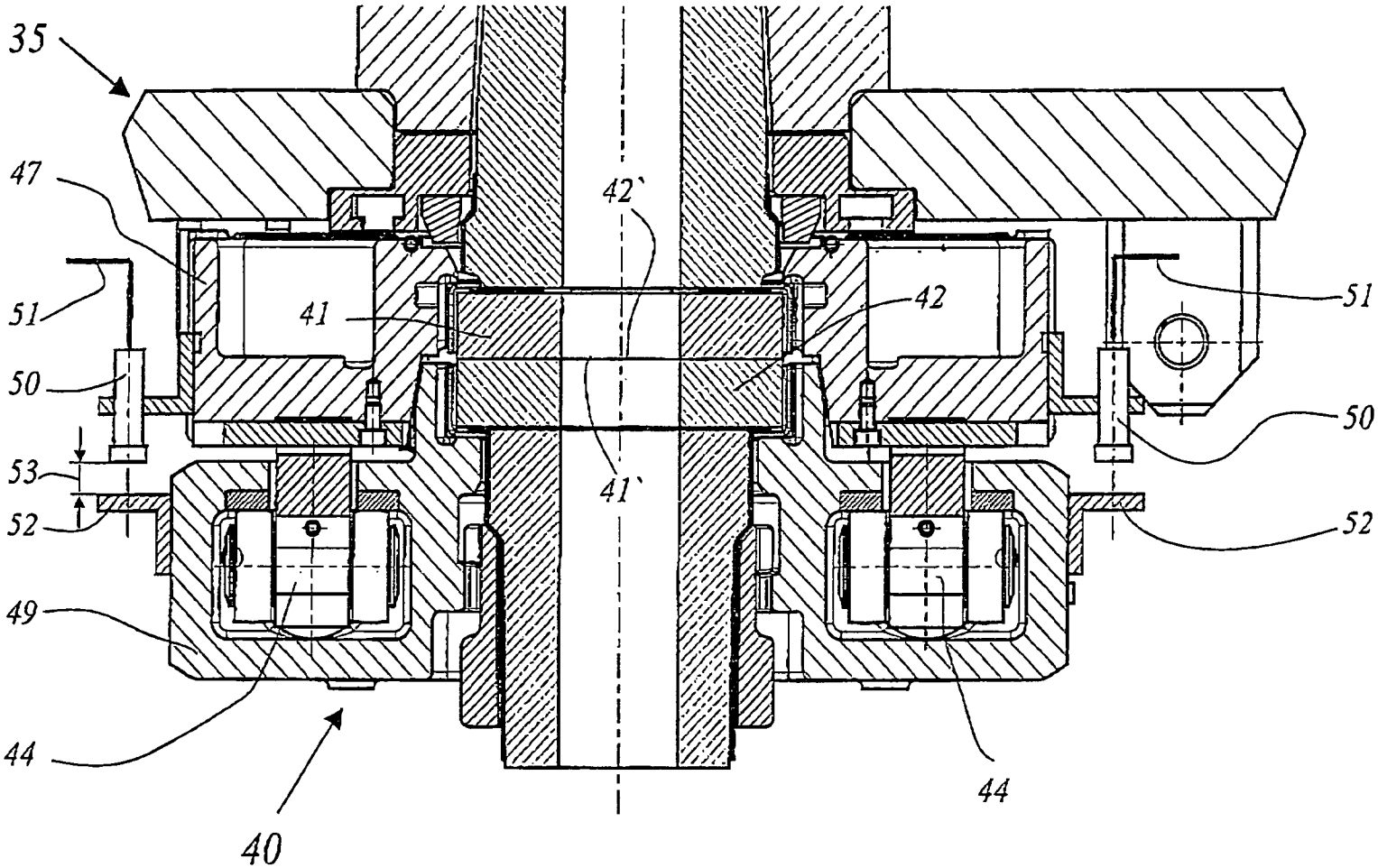
FIG. 2 shows a cross-sectional view of a sliding closure with a measuring unit.

FIG. 2 shows a sliding closure 40 which is described in detail in document WO-A-00/6325, of which only details relevant to this invention are mentioned below. An upper housing part 47 affixed to a vessel 35 is envisaged here together with a closure plate 41 that can be affixed within the same, as well as a lower housing part 49, in which a fireproof closure plate 42 is held, which is moveably arranged vertically in relation to a plane of FIG. 2. Roller guides 44 are located on the upper housing part 47, through which the housing part 49 is guided within the same in a moveable way. Spring elements effect movement of lower closure plate 42 towards upper closure plate 41 via these roller guides 44.

Within context of the invention the housing parts 47, 49 are preferably equipped with two measuring sensors 50 on both sides, each arranged at a distance from the other, with which a distance 53 of the two housing parts from one another in a transverse direction with relation to plate glide surfaces 41', 42' is recorded and transmitted to evaluating device 20 via a relevant cable 51. These measuring sensors 50 affixed to the upper housing part 47 each measure distance 53 to a measuring element 52 affixed to the lower housing 49.

These measuring sensors 50 and measuring elements 52 are preferably encapsulated in a way not described in detail here, so that the same are protected against damage. These sensors and elements can also be integrated directly into the housing parts 47, 49. In principle, a single measuring sensor 50 would also suffice.

With measuring of these distances 53, i.e. linear changes of the two housing parts 47, 49 in relation to one another, it is possible especially to diagnose a position of the closure plates 41, 42 with regard to transverse changes in relation to the glide surfaces 41', 42'. If, for example, steel smelt enters between the plates a thin sheet can form there which can press the plates apart and therefore create a risk of an uncontrolled outpouring of steel smelt across the glide surfaces between these plates.

The invention has been described sufficiently with reference to the above embodiments. However, various other embodiments are possible.

In principle, the sliding closure could be evaluated with aid of only one of the parameters described above, i.e. size, temperature, pressure and/or force, preferably in a program-controlled manner.

The invention claimed is:

1. A method for operating a sliding closure for a metallurgical vessel, the sliding closure including two tensionable fireproof closure plates opposing one another, with each of the two closure plates being slidably positioned within a corresponding housing part, and with spring elements being provided for tensioning the closure plates, wherein one of the closure plates, along with its corresponding housing part, is slidable and can be moved into a closed or open position by a drive member, said method comprising:

performing an offline and/or an online diagnosis of an operating condition within an area of the closure plates, by measuring at least one of size, temperature, pressure and force associated with the sliding closure so as to obtain at least one measured value, and evaluating the at least one measured value either directly or together with additional relevant process parameters; and based upon the diagnosis, one of (i) continuing use of the sliding closure, and (ii) discontinuing use of the sliding closure.

2. The method according to claim 1, wherein measuring at least one of size, temperature, pressure and force associated with the sliding closure comprises measuring a distance between the housing parts in a transverse direction relative to glide surfaces of the closure plates, and evaluating the at least one measured value comprises transmitting the distance, as measured, to an evaluating device.

3. The method according to claim 2, wherein measuring a distance between the housing parts in a transverse direction relative to glide surfaces of the closure plates comprises measuring distances between the housing parts, at plural locations, in a transverse direction relative to the glide surfaces of the closure plates, such that transmitting the distance, as measured, to an evaluating device comprises transmitting the distances, as measured, to the evaluating device.

4. The method according to claim 1, wherein measuring at least one of size, temperature, pressure and force associated with the sliding closure comprises measuring pressure of the drive member and a stroke position of the slideable closure plate, and evaluating the at least one measured value includes evaluating the pressure and stroke position, as measured, so as to judge a frictional relationship between the closure plates.

5. The method according to claim 1, wherein measuring at least one of size, temperature, pressure and force associated with the sliding closure comprises measuring a temperature at least one of (i) near the housing parts, (ii) near the closure plates, and (iii) at locations other than near the housing parts and near the closure plates.

6. The method according to claim 1, wherein measuring at least one of size, temperature, pressure and force associated with the sliding closure comprises measuring biasing forces applied by the spring elements in tensioning of the closure plates, and evaluating the at least one measured value includes evaluating the biasing forces, as measured, so as to determine whether either of the spring elements is no longer functional.

7. The method according to claim 1, wherein evaluating the at least one measured value comprises comparing the at least one measured value with one of a target value and a target value range, and one of (i) continuing use of the sliding closure, and (ii) discontinuing use of the sliding closure comprises one of (i) continuing use of the sliding closure if the at least one measured value deviates from the one of the target value and the target value range by no more than a predetermined amount, and (ii) discontinuing use of the sliding closure if the at least one measured value deviates from the one of the target value and the target value range by greater than the predetermined amount.

8. The method according to claim 7, further comprising:

adjusting the one of the target value and the target value range with aid of process parameters during use of the closure plates.

9. The method according to claim 1, wherein the metallurgical vessel includes a pan into which smelt is to be poured, and further comprising:

protocolling and storing the at least one measured value and data relating to the pan and the smelt to be poured, with regard to temperature, treatment, and pouring time, which are the additional relevant process parameters, and incorporating the additional relevant process parameters during determination of target values with which the at least one measured value is to be compared.

10. A sliding closure for a metallurgical vessel, comprising:

two tensionable fireproof closure plates opposing one another, with each of the two closure plates being positioned within a corresponding housing part, and with one of the closure plates, along with its corresponding housing part, being slidable;

spring elements for tensioning the closure plates;

a drive member for sliding the one of the closure plates, along with its corresponding housing part, into a closed or open position; and at least one measurement sensor located at least one of (i) near the housing parts, (ii) near the drive member, and (iii) locations other than near the housing parts and near the drive member, wherein the at least one measurement sensor is to measure at least one of size, temperature, pressure and force associated with the sliding closure so as to obtain at least one measured value, which at least one measured value is to be evaluated, either directly or together with additional relevant process parameters, such that an offline and/or an online diagnosis of an operating condition within an area of the closure plates can be performed, whereby, based upon the diagnosis, one of (i) continuing use of the sliding closure, and (ii) discontinuing use of the sliding closure, can be performed.

11. The sliding closure according to claim 10, wherein said at least one measurement sensor comprises at least one sensor for measuring a distance between the housing parts in a transverse direction relative to glide surfaces of the closure plates, which distance, as measured, is to be transmitted to an evaluating device as the at least one measured value to be evaluated.

12. The sliding closure according to claim 10, wherein said at least one measurement sensor comprises at least one sensor for measuring pressure of the drive member and a stroke position of the one of the closure plates, which pressure and stroke position, as measured, correspond to the at least one measured value to be evaluated and allow for a frictional relationship between the closure plates to be judged.

13. The sliding closure according to claim 10, wherein said at least one measurement sensor comprises at least one sensor for measuring a temperature at least one of (i) near the housing parts, (ii) near the closure plates, and (iii) at locations other than near the housing parts and near the closure plates.

14. The sliding closure according to claim 10, wherein said at least one measurement sensor comprises sensors for measuring biasing forces applied by the spring elements in tensioning of the closure plates, which biasing forces, as measured, correspond to the at least one measured value to be evaluated and allow for a determination to be made as to whether either of the spring elements is no longer functional.

* * * * *